United States Patent [19]

Hurt

[11] 4,164,229

[45] Aug. 14, 1979

[54] PORTABLE CIGARETTE MAKING MACHINE

[76] Inventor: James S. Hurt, P.O. Box 131, Hanover, Va. 23069

[21] Appl. No.: 779,027

[22] Filed: Mar. 18, 1977

[51] Int. Cl.[2] ..... A24C 5/08; A24C 5/44

[52] U.S. Cl. ..... 131/55; 131/60; 131/65; 131/78; 131/84 A; 131/84 C; 131/66 A

[58] Field of Search ..... 131/47, 48, 55, 65, 131/77, 78, 81 R, 81 A, 84 R, 84 A, 85, 86, 87, 49, 51, 58, 59, 60, 66 R, 66 A, 67, 68, 69, 70, 73, 21 R, 79, 106 R, 64 R, 20 A, 64 A, 63, 20 R, 65, 75, 108, 110, 84 C

[56] References Cited

U.S. PATENT DOCUMENTS

| | | | |
|---|---|---|---|
| 439,615 | 10/1890 | Vauselle | 131/65 |
| 518,261 | 4/1894 | Maxfield | 131/59 |
| 777,802 | 12/1904 | Paul et al. | 131/67 |
| 2,208,504 | 7/1940 | Arelt | 131/67 |
| 3,276,452 | 10/1966 | Dearsley | 131/21 R |
| 3,380,352 | 4/1968 | Garton | 131/69 |
| 3,646,942 | 3/1972 | Asbill et al. | 131/66 A |
| 3,915,176 | 10/1975 | Heitmann et al. | 131/66 R |

*Primary Examiner*—Robert W. Michell
*Assistant Examiner*—V. Millin
*Attorney, Agent, or Firm*—John J. Byrne

[57] ABSTRACT

A portable cigarette making machine which has a horizontal conveyor belt adapted to support a continuous strip of cigarette paper, paper forming means which engage the conveyor belt and cause it to fold the cigarette paper into a concave trough, a conveyor feed adapted to feed tobacco vertically into the cigarette paper trough, a rotary compactor adapted to roll the tobacco into a generally cylindrical rod in said cigarette paper trough, an adhesive applicator engaging one side edge of the cigarette paper, a final paper forming means which engages the conveyor belt and causes it to fold the cigarette paper around the tobacco rod to form a cigarette rod, and cut-off means for cutting the cigarette rod into cigarette lengths.

The paper forming means comprises outer and inner formers, the outer former engaging the conveyor belt, the inner former engaging the paper, said inner former having a tubular section through which the tobacco is carried, said tubular section being open to the tobacco feed and the cigarette paper to provide direct tobacco flow therebetween, said tubular section being also open to the rotary compactor to provide direct contact between said compactor and the tobacco to form a tobacco rod. The conveyor feed is provided with a vertically extending, cleated conveyor belt which is synchronized with the horizontal conveyor belt and the rotary compactor, whereby the tobacco feed is metered in synchronization with the travel of the cigarette paper and the operation of the rotary compactor.

7 Claims, 25 Drawing Figures

PORTABLE CIGARETTE MAKING MACHINE

BACKGROUND OF THE INVENTION

1. Field of the Invention

This invention relates to non-commercial production of cigarettes not intended for resale on the commercial market. The invention relates to small, portable cigarette making machines intended for domestic use by individual owners.

2. Prior Art

The closest prior patent art known to applicant consists of the following U.S. Pat. Nos.:

| | | |
|---|---|---|
| 1,892,143 | Gordon | December 27, 1932 |
| 1,949,654 | Norris | March 6, 1934 |
| 3,084,697 | Eissmann | April 3, 1963 |
| 3,128,773 | Patterson | April 14, 1964 |
| 3,237,628 | Riegger | March 1, 1966 |
| 3,244,182 | Eissmann | April 5, 1966 |
| 3,261,364 | Korber | July 19, 1966 |
| 3,477,442 | Hooper | November 11, 1969 |
| 3,921,644 | Lohe | November 25, 1975 |

These prior art patents relate mainly to large commercial cigarette making machines which are not feasible for domestic use in small quantity production. They are concerned with mass production runs requiring huge supplies of tobacco and special handling and processing methods. For example, Eissmann U.S. Pat. No. 3,244,182 compresses the tobacco in advance of feeding it to the cigarette paper and deposits it on the paper in the form of thin, compressed, overlapping layers. Eissmann U.S. Pat. No. 3,084,697 deposits compressed tobacco wafers on a conveyor belt, then shreds the wafers, and deposits the shredded tobacco on the cigarette paper. Patterson U.S. Pat. No. 3,128,773 forms a tobacco slurry and then uses electrostatic means to funnel the slurry to a conveyor belt. Lohe U.S. Pat. No. 3,921,644 and Korber U.S. Pat. No. 3,261,364 show very complicated machines and control mechanisms. Gordon U.S. Pat. No. 1,892,143 shows a cigarette making machine which could be used non-commercially, but it operates on a screw-principle, which feeds into a preformed paper tube. Gordon's patent does not teach the making of the paper tube.

Norris U.S. Pat. No. 1,949,654 shows a strip of cigarette paper riding on an endless conveyor belt and means for forming the cigarette paper, operating through the conveyor belt, into a trough-shaped receptacle for receiving tobacco. But it does not show a positive-feed device in the form of a cleated conveyor belt, synchronized with the movement of the cigarette paper, for metering the flow of tobacco into the cigarette paper. Nor does Norris show a tobacco compacting means which is synchronized with both the tobacco feed and the paper travel for compacting the tobacco into a tobacco rod.

SUMMARY OF THE INVENTION

This invention is of a small, compact, electric-powered cigarette making machine which is adapted for non-commercial use. During operation, it feeds a continuous strip of cigarette paper and a continuous stream of shredded tobacco, it compresses the tobacco on the cigarette paper to form a tobacco rod, it rolls the cigarette paper around the tobacco rod, and it adhesively secures the edges of the cigarette paper together to form a cigarette rod. Cutting means are provided to cut the cigarette rod to predetermined lengths.

An important feature of the invention resides in the use of a conveyor belt to support the cigarette paper at all stages of its progress through the machine, and the conveyor belt, in turn, is supported by forming means occupying the several stages of the operation of the machine. Thus, the conveyor belt supports the paper at the station where tobacco is deposited thereon, it supports the paper at the compacting station where the tobacco is compressed to form a tobacco rod, it supports and folds the paper through all folding stages, it supports the paper at the adhesive application stage, it supports and folds the paper to form a cigarette rod, and it supports the cigarette rod at the cutting station. In short, all of the paper handling and forming operations are performed through and by means of the conveyor belt. This insures against damage to the paper even when the machine is operated by unskilled people.

An important feature of the forming means resides in its use of both outer and inner formers. The outer (bottom) former is concave, in cross-section, and it provides a concave trough or channel for the conveyor belt. The cross-sectional shape of the concave channel progressively changes from a relatively wide, shallow configuration having a relatively long radius of curvature exceeding the radius of a conventional cigarette, to a relatively narrow configuration with a relatively short radius of curvature, namely, the radius of a conventional cigarette.

The inner (top) former comprises a series of forming elements which cooperate with the outer former at the several stations of the machine to progressively form a paper tube out of the paper strip that feeds into the machine. It is open at the top to enable the tobacco feed to deposit tobacco onto the cigarette paper and to enable a rotary compactor to compress the tobacco and form it into a tobacco rod. The inner former is open at the bottom to enable the cigarette paper to carry and transport the tobacco, including the tobacco rod formed therefrom, and to support the tobacco at the compacting station.

Another important feature resides in the tobacco feed which utilizes a cleated, vertically extending conveyor belt to deposit the tabacco on the cigarette paper. This tobacco feed belt is synchronized with the paper carrying conveyor belt to meter the flow of tobacco to the paper. Whatever the speed of the machine may be, the flow of tobacco is synchronized with the progress of the paper through the machine.

The invention provides a rotary compactor which transforms the loose, shredded tobacco into a relatively compact tobacco rod. This rotary compactor is synchronized with the tobacco feed and the main conveyor belt and the tobacco feed conveyor belt to synchronize the compacting operation with all of the other operations of the machine.

An important feature of the tobacco feed resides in the tobacco hopper which houses the cleated conveyor belt. This hopper is relatively small and readily accessible for tobacco replenishing purposes. It may be used to produce a given quantity of cigarettes and its tobacco contents may then be replaced with other tobacco varieties and mixtures for changes of taste, fragrance and other tobacco properties. The hopper may be kept closed to retain the moisture in its tobacco contents.

DESCRIPTION OF DRAWING

FIG. 6 is a longitudinal, vertical section through the machine on the line 6—6 of FIG. 2.

DESCRIPTION OF PREFERRED EMBODIMENT OF INVENTION

Figure 1:
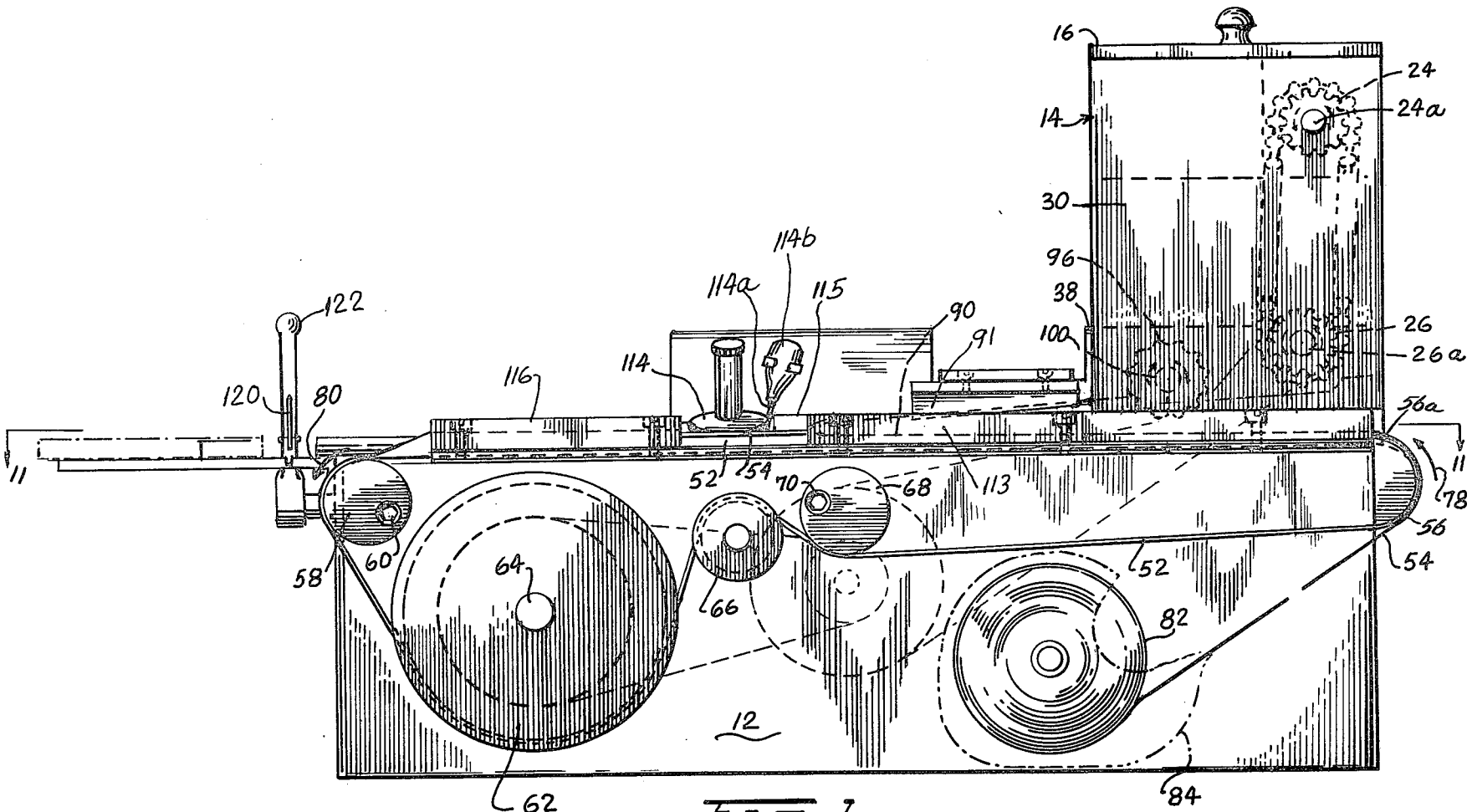
FIG. 1 is a side view of a cigarette making machine made in accordance with this invention.
Figures 2, 3:
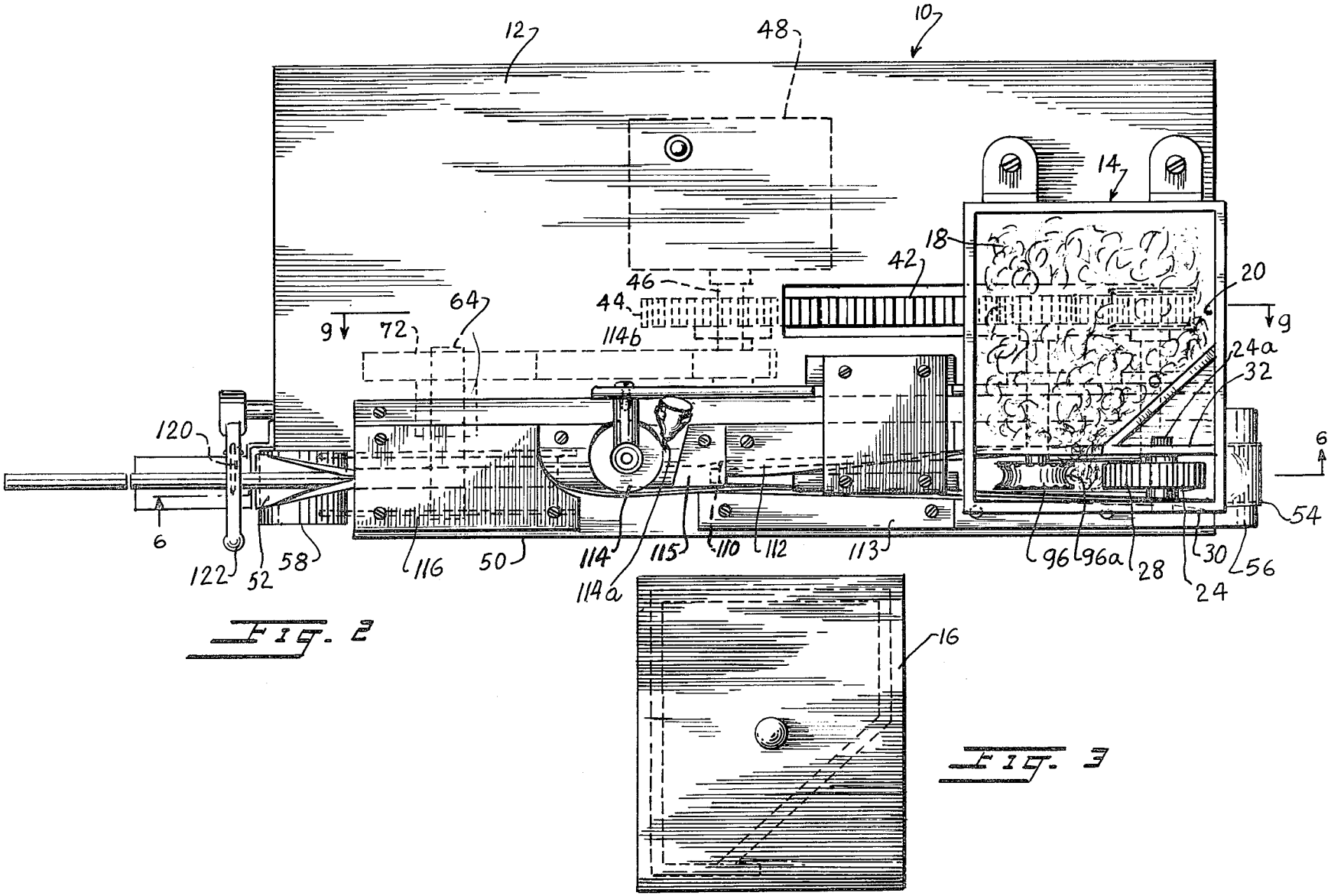
FIG. 2 is a top view thereof with the hopper cover removed.
FIG. 3 is a top view of the hopper with its cover in place.
Figure 5:
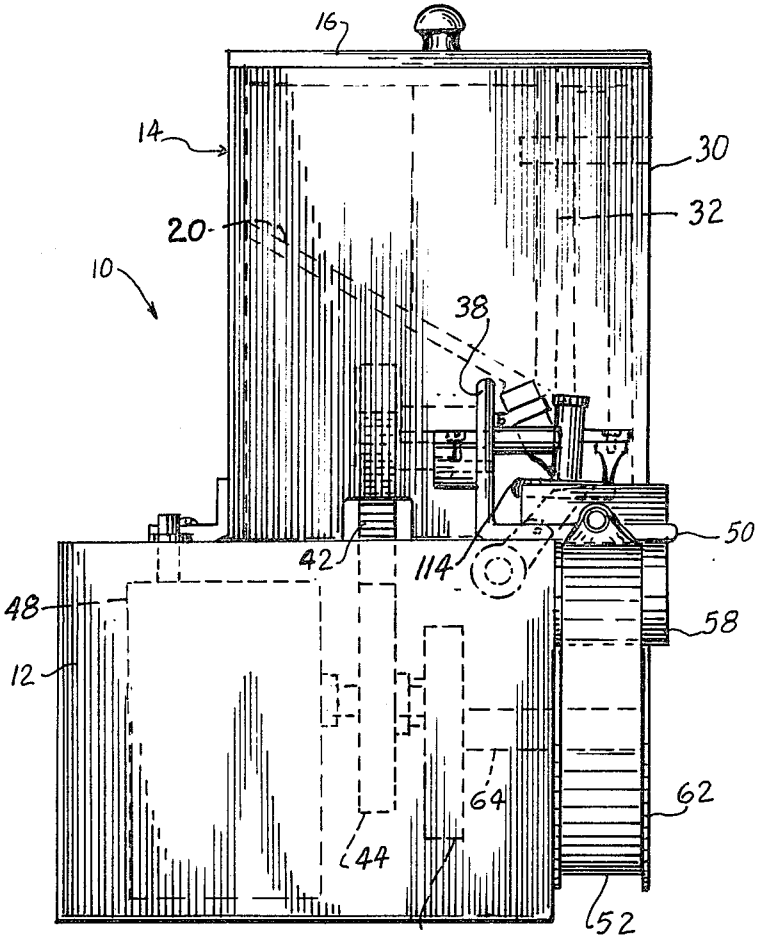
FIG. 5 is a view of the discharge end of the machine.
Figure 4:
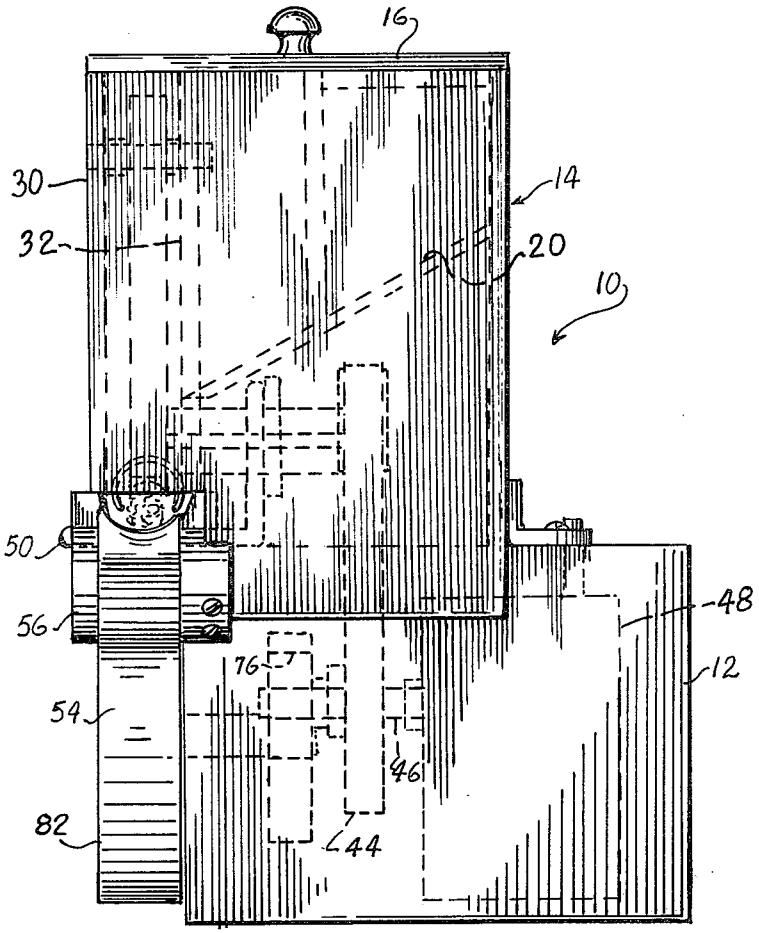
FIG. 4 is a view of the feed end of the machine.
Figure 5:
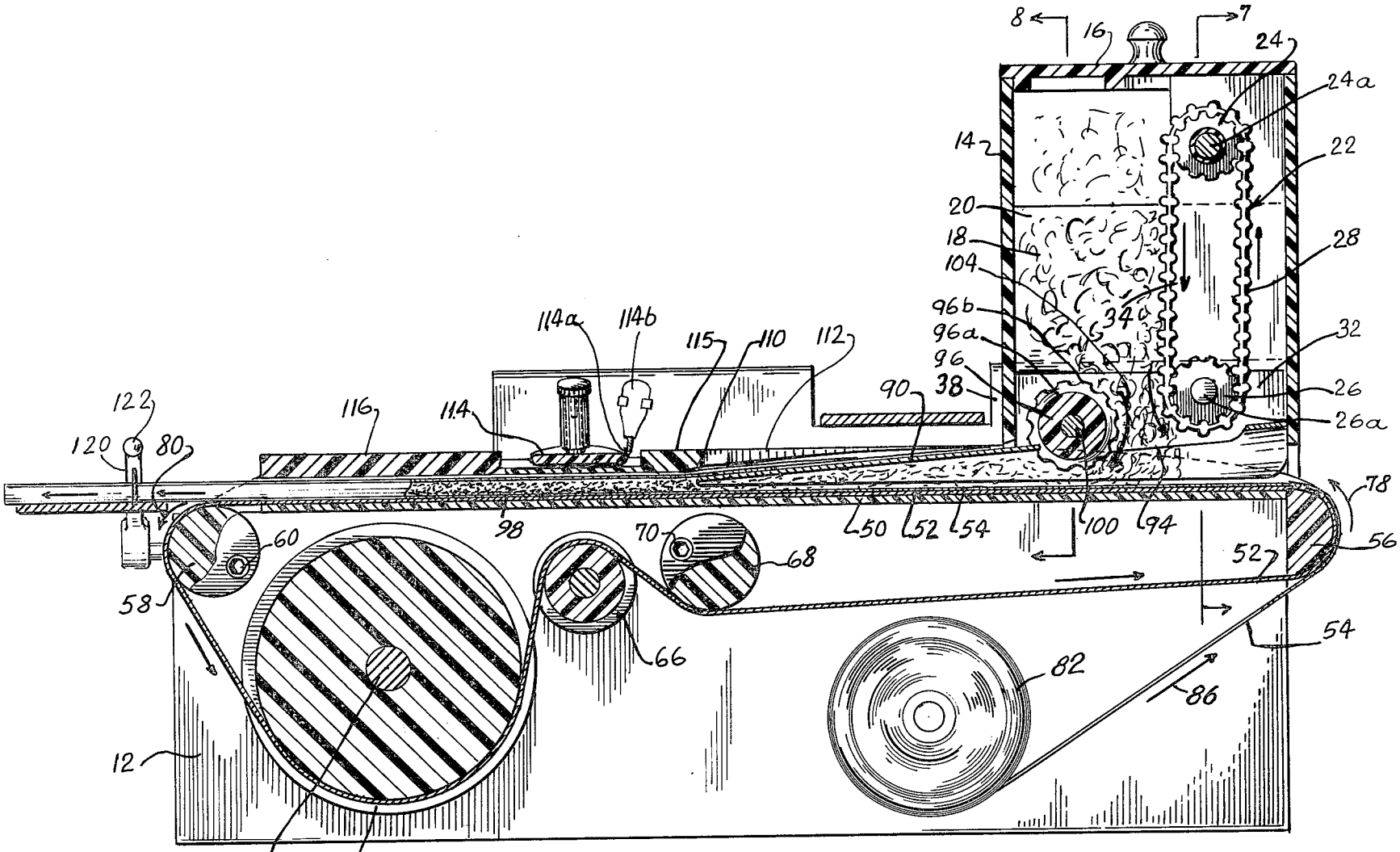
Figure 7:
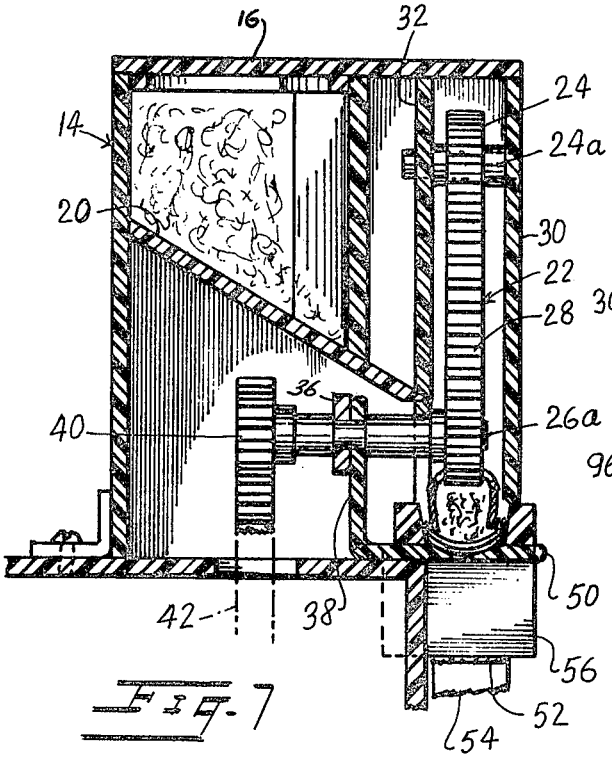
FIG. 7 is a transverse, vertical section through the machine on the line 7—7 of FIG. 6.
Figure 8:
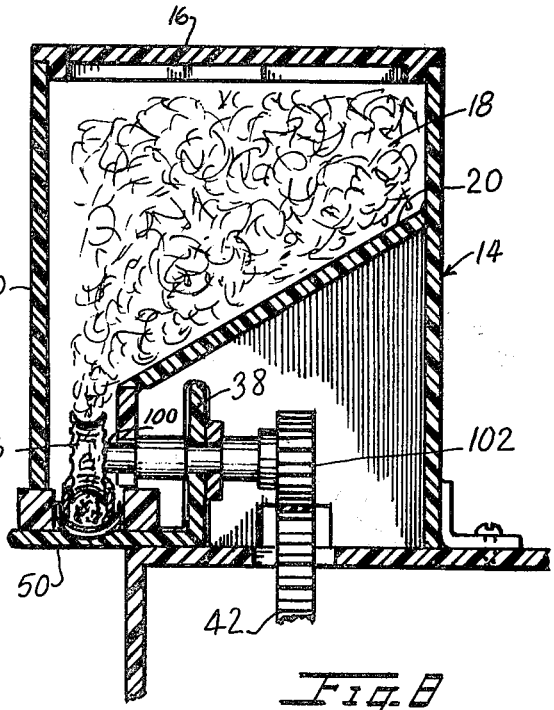
FIG. 8 is a transverse, vertical section through the machine on the line 8—8 of FIG. 6.

Referring now to the details of the invention as illustrated in the drawings it will be seen that cigarette making machine 10, made in accordance with a preferred embodiment of the invention, includes a base or frame 12 which supports a tobacco hopper 14 having a cover 16. This hopper is adapted to receive and hold shredded tobacco 18 and the cover is adapted to perform the conventional purpose of keeping the tobacco clean and retaining its moisture. The hopper is readily accessible for ease of replenishing the supply of tobacco or replacing the consumed tobacco with other varieties and mixes.

The hopper also serves to feed the tobacco to the cigarette making mechanism, and, in that connection, the hopper is provided with one or more inclined baffles 20 to funnel the tobacco to the feeding station. Mounted in the hopper is conveyor belt feed means 22 comprising a pair of toothed pulleys 24, 26 and a double-cleated belt 28 mounted on said pulleys. The pulleys are mounted on axles **24*a* and 26*a*, respectively, which are journalled into walls 30,32 of hopper 14 and it is between these walls that the pulleys and their belt operate. It will be seen, of course, that the belt is exposed to the tobacco so that when the belt moves in the direction of arrow 34** its outer cleats engage and feed the tobacco downwardly.

The mechanism which drives the cleated belt will now be described. Shaft **26*a* extends outwardly from wall 32 and is supported by a suitable bearing 36 on bracket 38. Secured to the outwardly extending end of shaft 26*a* is a third toothed pulley 40. A toothed belt 42 connects pulley 40 to a fourth toothed pulley 44 mounted on shaft 46 of motor 48. This motor may be a battery-powered or a household current-powered motor, as desired, and it includes a speed-reducing gear box or the like to drive shaft 46 at the slow speed and adequate torque requirements of the cigarette making mechanism. Pulley 44 drives belt 42 which drives pulley 40, whereby feed belt 28 is driven in the direction of arrow 34**.

Base 12 is provided with a channel 50 which is adapted to support the upper run of an endless conveyor belt 52, which, in turn, supports a strip of cigarette paper 54. More specifically, conveyor belt 52 is mounted on a curved bearing 56 and eccentric bearing 58 which are supported at opposite ends of channel 50. Bearing 56 is fixed, while bearing 58 is adjustable around clamp bolt 60 to adjust the tension in the belt. Belt 52 also extends over a drive pulley 62 mounted on shaft 64, over an idler pulley 66, and under a second eccentric bearing 68 which is adjustable about clamp bolt 70 for adjustment of the tension in said belt 52.

Secured to shaft 64 is another pulley 72 which is connected by means of drive belt 74 to a drive pulley 76 on motor shaft 46. It is by this means that the conveyor belt 52 is driven in the direction of arrows 78, 80.

Cigarette paper strip 54 is fed from a roll or reel 82 rotatably mounted in a holder 84. This holder is secured to base 12 by any suitable bracket or fastening means. The paper strip frictionally engages the conveyor belt 52 and moves with it in the direction of arrows 86, 78 and 80.

Channel 50 is a continuous element or series of elements providing continuous support for the upper run of the conveyor belt 52. However, it provides more than support. In the cigarette making machine industry channel 50 is called a "garniture" or "garniture section". It serves as a guide to progressively curve the conveyor belt, and thereby to curve the cigarette paper, in the several operative stages or stations of the machine.

It will be noted that the bearing surface of fixed bearing 56 is concavely groove to impart a slightly curved cross-sectional configuration to the conveyor belt, dasher **56*a*, FIG. 1. Channel 50 is also concavely shaped (in cross-section) to support the conveyor belt in curved configuration as it moves through the machine. The strip of cigarette paper 54 meets the conveyor belt 52 at bearing 56 and is carried by the conveyor belt through the machine to the discharge end of channel 50 adjacent adjustable bearing 58. The curvature which bearing 56 and channel 50** impart to the conveyor belt is imparted by said conveyor belt to the cigarette paper.

The cross-sectional concavity of channel 50 progressively tightens in the direction of its discharge end. As its feed end (adjacent bearing 56) its concave configuration is relatively shallow, its radius of curvature substantially exceeding that of a conventional cigarette. As its discharge end, the concave configuration of channel 50 has a radius of curvature corresponding to the radius of curvature of a cigarette. See FIGS. 12–18,25.

Figures 11, 12, 13, 14, 15, 16, 17, 18:
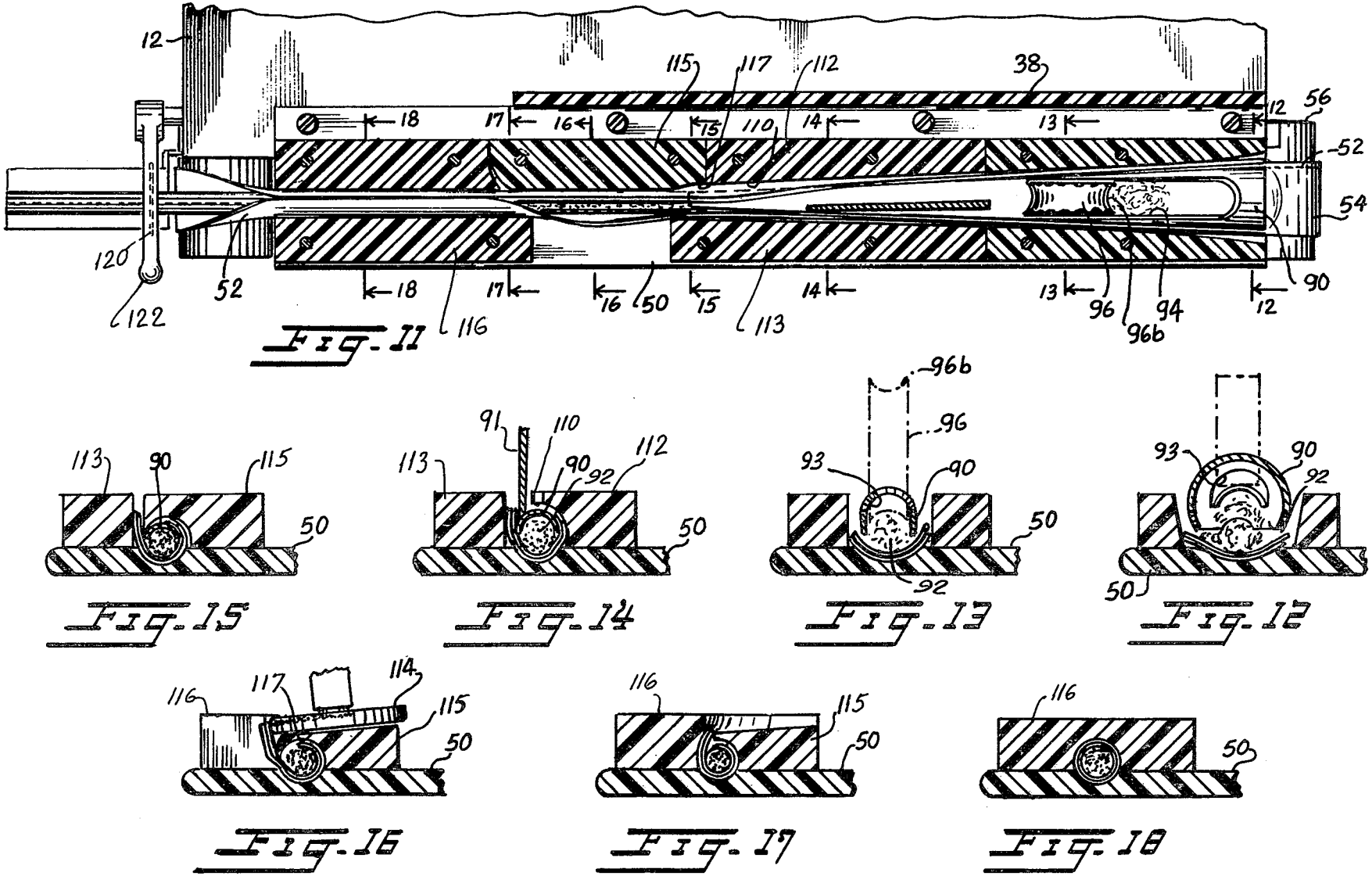
FIG. 11 is a longitudinal, horizontal section on the line 11—11 of FIG. 1.
FIG. 12 is a fragmentary section on the line 12—12 of FIG. 11.
FIG. 13 is a fragmentary section on the line 13—13 of FIG. 11.
FIG. 14 is a fragmentary section on the line 14—14 of FIG. 11.
FIG. 15 is a fragmentary section on the line 15—15 of FIG. 11.
FIG. 16 is a fragmentary section on the line 16—16 of FIG. 11.
FIG. 17 is a fragmentary section on the line 17—17 of FIG. 11.
FIG. 18 is a fragmentary section on the line 18—18 of FIG. 11.

Tubular former 90 comprises an upper guide section in the area of the tobacco fedding and compacting stations. It defines an incomplete tube, however, in that it is open at the bottom along its full length. The elongated opening or slot in tubular former 90 is shown in FIGS. 12–14, designated by the reference numeral 92. As will be seen, tubular former 90 is supported by bracket 91 above, and in alignment with, concave channel 50, and its elongated opening 92 faces said concave channel 50 to receive the conveyor belt and cigarette paper between them.

At the tobacco feeding station, under conveyor feeder 22, is the tobacco discharge opening 94 in the tobacco hopper. As conveyor belt 52 with its strip of cigarette paper moves between channel 50 and tubular former 90, conveyor feeder 22 feeds tobacco to the paper through an opening in the top of the tubular former. Since the conveyor feeder is synchronized with the conveyor belt, the tobacco feeding rate is synchronized with the progress of the conveyor belt through the machine.

Figure 23:
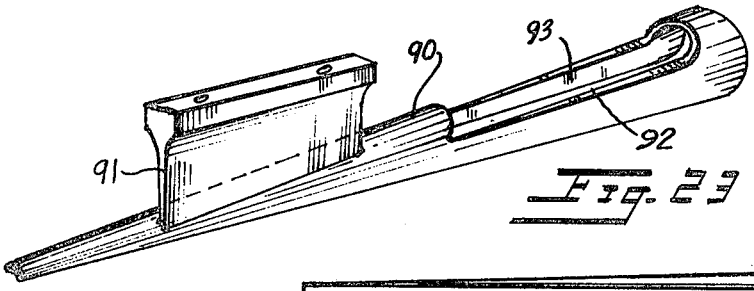
FIG. 23 is a perspective view of a further component of the machine.
Figure 24:
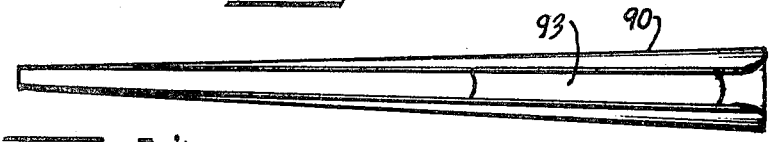
FIG. 24 is a bottom view of the component shown in FIG. 23.
Figure 25:
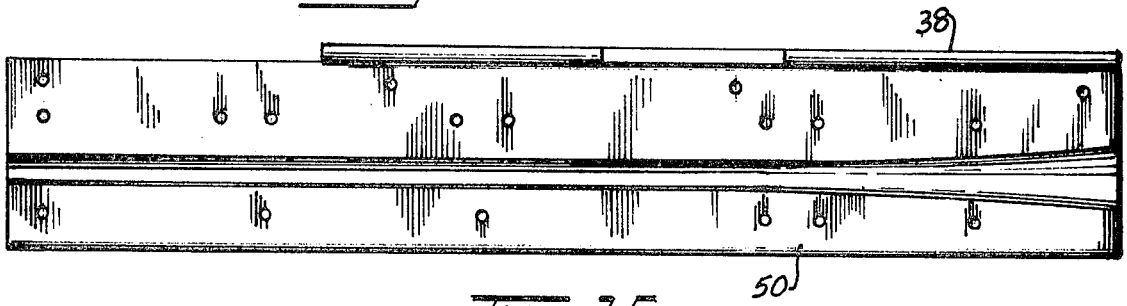
FIG. 25 is a top view of still another component of the machine.
Figure 9:
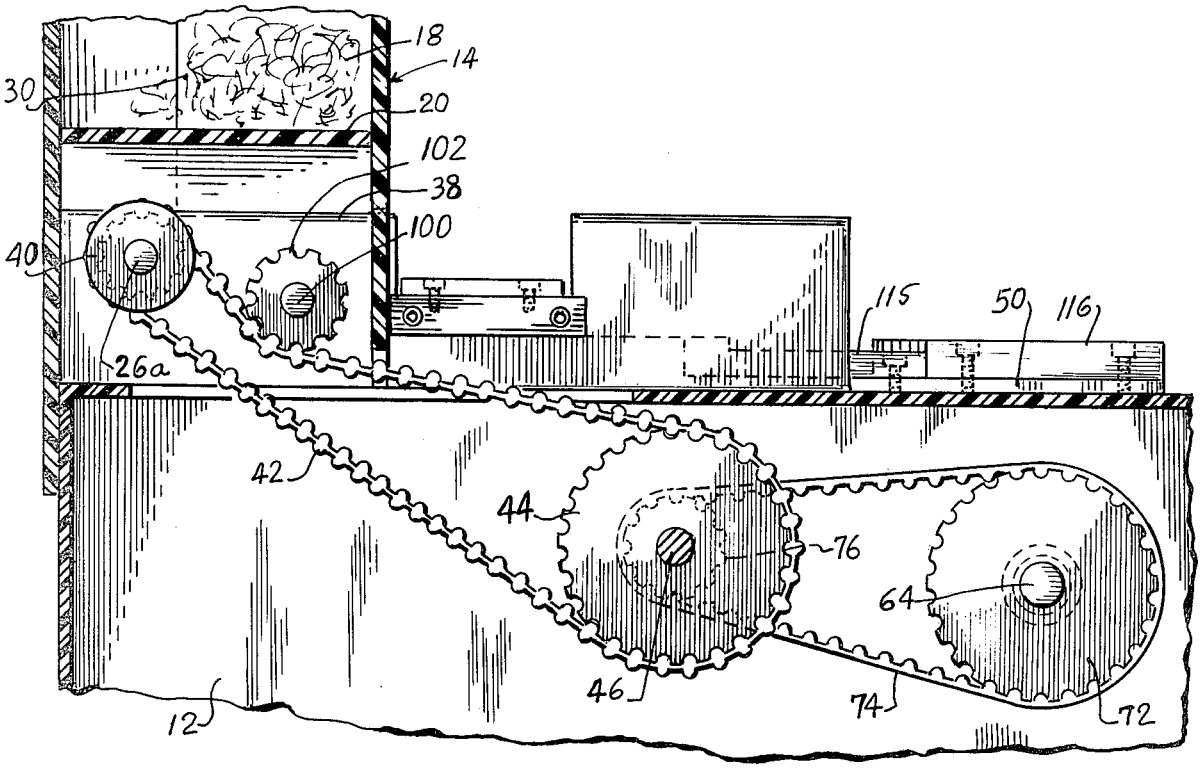
FIG. 9 is a fragmentary, longitudinal, vertical section on the line 9—9 of FIG. 2.
Figure 10:
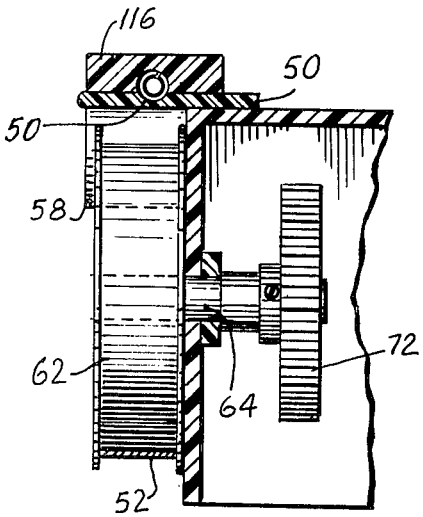
FIG. 10 is a fragmentary vertical section on the line 10—10 of FIG. 9.
Figure 19:
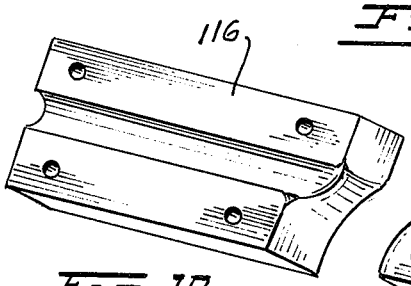
FIG. 19 is a perspective view of one of the components of the machine.
Figure 20:
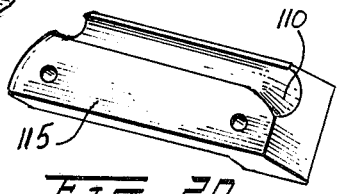
FIG. 20 is a perspective view of another component of the machine.
Figure 21:
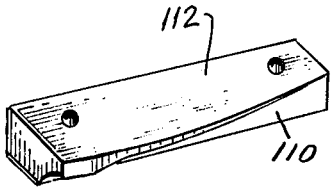
FIG. 21 is a perspective view of still another component of the machine.
Figure 22:
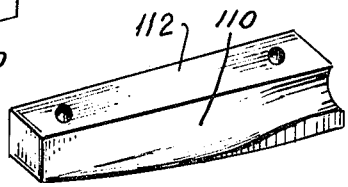
FIG. 22 is another perspective view of the component shown in FIG. 21.

As the conveyor belt 50 and cigarette paper carried thereby move into the tobacco compacting station a rotary compactor 96 engages and compacts the tobacco to form an incipient tobacco rod 98. In order for the rotary compactor or wheel to reach the tobacco, the tubular former must be open at the top, as it is at the bottom, in the compacting station. See top slot 93, aligned with channel 50, FIGS. 23, 13.

Rotary compactor 96 is a wheel, with a concave groove **96*a* formed circumferentially thereof, and a series of serrations 96*b* along both peripheral edges on opposite sides of the concave groove. Rotary compactor 96 is mounted at one end of a shaft 100 which is supported by suitable mountings, such as bracket 38 and wall 32, at the bottom of the tobacco hopper. At the opposite end of shaft 100 from rotary compactor 96 is a toothed pulley 102 which engages drive belt 42. Since drive belt 42 also drives the tobacco feed belt 28**, it will be apparent that the operation of the rotary compactor will be synchronized with the tobacco feed.

The direction of rotation of the rotary compactor is shown by arrow 104. It will be understood that in the area of contact between said rotary compactor and the cigarette paper, both move in the same direction and at the same velocity. This means that not only does the rotary compactor compact the tobacco, but that it also cooperates with the cigarette paper in moving the tobacco through tubular former 90. After the tobacco leaves the rotary compactor (the tobacco is now in rod form) it is carried through said tubular former 90 by the cigarette paper.

Before the conveyor belt 52 and cigarette paper 54 leave the tubular former 90, they encounter curved deflector surface 110 of former block 112 which curves one side of the conveyor belt and cigarette paper over upon the discharge end of said tubular former 90. See FIG. 14. On the opposite side of the tubular former 90 is another block 113 which cooperates with said tubular former in supporting the opposite side of the conveyor belt and cigarette paper in upright position. See FIG. 14.

After the conveyor belt and cigarette paper leave block 112 and before they leave block 113, they make contact with another block 115 which abuts block 112. See FIG. 11. Block 115 has a curved deflecting surface 117 which is substantially continuous with curved deflecting surface 110 of block 112 and curls the conveyor belt and cigarette paper over upon the tobacco rod. See FIG. 15.

The upwardly extending side of the cigarette paper, still supported by the upright side of the conveyor belt, is now moved into contact with an adhesive applicator wheel 114. See FIG. 16. This is a conventional paste wheel which is kept coated with a suitable adhesive by means of a conventional applicator **114*a* connected with a conventional container 114*b***.

At the conclusion of the adhesive (or water) coating operation, the conveyor belt and cigarette paper are moved into the final folding station. Here, a former block 116 engages the upwardly extending side edge of the conveyor belt and cigarette paper and curls them over upon the previously curled side edge of the paper, thereby causing adhesion between the two side edges of the paper and forming a tubular cigarette rod. See FIGS. 17 and 18.

The cigarette rod is now self-supporting and it no longer requires the conveyor belt to carry it. The final stage in the cigarette making procedure is now reached and it is here that the cigarette rod is severed into conventional cigarette lengths. This is done by conventional cutting means 120 manually operated by means of handle 122.

The foregoing is a description of a preferred embodiment of this invention and it will be understood that design modifications may be incorporated therein within the scope of the appended claims. Such modifications include substitutions of conventional components. For example, the cigarette rod cutter shown in the drawing illustrates a scissors or shear type. Other conventional cutters, whether rotary or linear or other, may equally be used in this invention.

I claim:

1. A cigarette making machine comprising:

(a) a portable base including a longitudinally extending channel;

(b) a power driven first conveyor belt supported by said base, said first conveyor belt having a horizontally oriented run supported by said channel;

(c) a paper feeder on said base for feeding a strip of cigarette paper longitudinally to said first conveyor belt to be carried thereby;

(d) a generally vertical tobacco feeder, including a hopper, for feeding tobacco to the cigarette paper at the beginning of said horizontally oriented run;

(e) said channel being adapted to curve said first conveyor belt and cigarette paper carried by said first conveyor belt transversely of themselves to define a longitudinally extending, concavely shaped trough in the cigarette paper for the tobacco;

(f) a rotary compactor mounted on said base to engage the tobacco in said cigarette paper trough and to compact the tobacco into a substantially cylindrical rod in said cigarette paper trough;

(g) a first paper former having a curved deflector surface which is adapted to curl the corresponding sides of said first conveyor belt and cigarette paper carried by said first conveyor belt over the tobacco rod;

(h) an applicator wheel mounted on said base at the discharge end of said paper former for engagement with the opposite side of the cigarette paper for applying adhesive thereto;

(i) a second paper former mounted on said base following said applicator wheel and adapted to curl said opposite side of the cigarette paper over upon the first mentioned side thereof, said second paper former being adapted to cause the two sides of the cigarette paper to overlap and adhere to each other, thus forming a tubular cigarette rod;

(j) said tobacco feeder comprising a second conveyor belt mounted on a pair of pulleys, said second conveyor belt carrying a plurality of raised means which are exposed to the tobacco in said hopper for engagement therewith;

(k) first means for operating said second conveyor belt in synchronization with the operation of said first conveyor belt to feed the tobacco to the cigarette paper in synchronization with travel of the paper through the machine; and (l) second means for connecting said rotary compactor to said first conveyor belt to compact the tobacco rod in synchronization with the feeding of the tobacco onto the cigarette paper and the travel of the cigarette paper through the machine.

2. A cigarette making machine in accordance with claim 1 and further comprising cut-off means mounted on said base at the discharge end of said second paper former for cutting the tubular cigarette rod to selected cigarette lengths.

3. A cigarette making machine in accordance with claim 1 wherein said rotary compactor is connected to said first conveyor belt for rotation in a direction such that said rotary compactor and said first conveyor belt move in the same direction at their facing surfaces, whereby said rotary compactor cooperates with the cigarette paper carried by said first conveyor belt in moving the tobacco through the machine.

4. A cigarette making machine in accordance with claim 3 wherein said rotary compactor is provided with serrated peripheral edges which are engageable with the cigarette paper carried by said first conveyor belt, whereby said rotary compactor is adapted to cooperate with said first conveyor belt in moving the cigarette paper through the machine.

5. A cigarette making machine comprising:

(a) a conveyor belt;

(b) first means for feeding cigarette paper onto said conveyor belt;

(c) second means for feeding tobacco onto cigarette paper on said conveyor belt;

(d) third means for forming a cigarette rod from the tobacco and the cigarette paper, said means including a rotary compactor in position to engage the tobacco on said cigarette paper and to compact it into a substantially cylindrical rod; and (e) fourth means for connecting said rotary compactor to said conveyor belt to compact the tobacco rod in synchronization with the travel of the cigarette paper through the machine.

6. A cigarette making machine comprising:

(a) a portable base including a longitudinally extending channel;

(b) a power driven first conveyor belt having a horizontally oriented run supported by said channel;

(c) a paper feeder on said base for feeding a strip of cigarette paper longitudinally to said first conveyor belt to be carried thereby;

(d) a generally vertical tobacco feed including:

(i) a hopper for feeding tobacco to the cigarette paper at the beginning of said horizontally oriented run and (ii) a second conveyor belt mounted on a pair of pulleys and having a plurality of means for engaging tobacco within said hopper for delivering tobacco out of said hopper to cigarette paper carried by said first conveyor belt;

(e) first means for operating said second conveyor belt in synchronization with the operation of said first conveyor belt to feed the tobacco to the cigarette paper in synchronization with travel of the paper through the machine;

(f) said channel being adapted to curve said first conveyor belt and cigarette paper carried by said first conveyor belt transversely of themselves to define a longitudinally extending, concavely shaped trough in the cigarette paper for the tobacco;

(g) a rotary compactor mounted on said base to engage the tobacco in the cigarette paper trough and to compact the tobacco into a substantially cylindrical rod in said cigarette paper trough;

(h) second means for forming cigarette paper about the compacted tobacco rod to form a cigarette rod; and (i) third means for connecting said rotary compactor to said first conveyor belt to compact the tobacco rod in synchronization with the feeding of the tobacco onto the cigarette paper and the travel of the cigarette paper through the machine.

7. A cigarette making machine in accordance with claim 6 wherein said rotary compactor is provided with serrated peripheral edges and is mounted upon said portable base in a posture opposed to said second conveyor belt such that said rotary compactor acts in concert with said second conveyor to deliver tobacco out of said hopper and onto cigarette paper carried by said first conveyor.

* * * * *